US012637749B2

(12) United States Patent
Soka et al.

(10) Patent No.: US 12,637,749 B2
(45) Date of Patent: May 26, 2026

(54) CONTROL SYSTEM FOR HEAVY METALLIC COATING WEIGHT

(71) Applicant: NV BEKAERT SA, Zwevegem (BE)

(72) Inventors: Martin Soka, Leopoldov (SK); Kristof Mouton, Ingelmunster (BE); Pavol Hertel, Šalgovce (SK); Dries Rollez, Harelbeke (BE); Dominiek Verkinderen, Wortegem-Petegem (BE); Tim Bruggeman, Heule (BE)

(73) Assignee: NV BEKAERT SA, Zwevegem (BE)

( * ) Notice: Subject to any disclaimer, the term of this patent is extended or adjusted under 35 U.S.C. 154(b) by 0 days.

(21) Appl. No.: 18/840,625

(22) PCT Filed: Mar. 1, 2023

(86) PCT No.: PCT/EP2023/055097
§ 371 (c)(1),
(2) Date: Aug. 22, 2024

(87) PCT Pub. No.: WO2023/186438
PCT Pub. Date: Oct. 5, 2023

(65) Prior Publication Data

US 2025/0163560 A1 May 22, 2025

(30) Foreign Application Priority Data

Mar. 28, 2022 (EP) ..... 22164729

(51) Int. Cl.
*C23C 2/14* (2006.01)
*C23C 2/00* (2006.01)
*C23C 2/38* (2006.01)

(52) U.S. Cl.
CPC ..... *C23C 2/14* (2013.01); *C23C 2/003* (2013.01); *C23C 2/38* (2013.01); *C23C 2/51* (2022.08)

(58) Field of Classification Search
None
See application file for complete search history.

(56) References Cited

FOREIGN PATENT DOCUMENTS

| | | | | |
|---|---|---|---|---|
| CN | 102912275 | | 2/2013 | |
| CN | 105886990 | | 8/2016 | |
| CN | 106637026 | | 5/2017 | |
| CN | 109023199 | A * | 12/2018 | ..... C23C 2/14 |
| EP | 3 865 602 | | 8/2021 | |
| KR | 20020050885 | A * | 6/2002 | |
| WO | 2005/116576 | | 12/2005 | |
| WO | WO-2022135828 | A1 * | 6/2022 | ..... C23C 2/20 |

OTHER PUBLICATIONS

International Search Report and Written Opinion of the International Searching Authority issued Mar. 17, 2023, in International (PCT) Application No. PCT/EP2023/055097.

* cited by examiner

*Primary Examiner* — Alexander M Weddle
(74) *Attorney, Agent, or Firm* — Wenderoth, Lind & Ponack, L.L.P.

(57) ABSTRACT

It is provided a method and device to control the thickness of a metallic coating on a steel wire. A device (101) for controlling a metallic coating thickness on a steel wire comprises: —a digital proportional valve (113); —a digital flow meter (111); —a pressure sensor (115); —a thickness sensor (105); —a gas nozzle (119); —a computer (107); and is characterized in that the relation between the gas flow measured by said digital flow meter (111) and the coating thickness measured by said thickness sensor (105) for said gas nozzle (119) is linear or parabolic.

9 Claims, 2 Drawing Sheets

CONTROL SYSTEM FOR HEAVY METALLIC COATING WEIGHT

TECHNICAL FIELD

Figure 1:
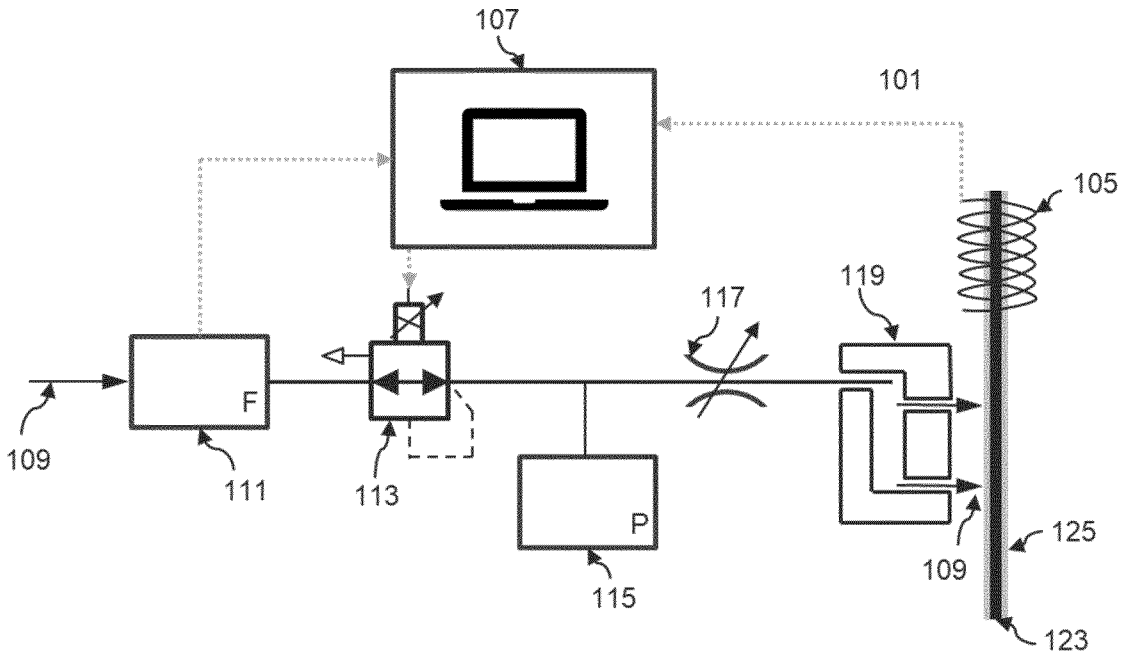

The invention relates to a method and device for controlling the metallic coating thickness on a steel wire.

BACKGROUND ART

Steel wires may be used in many applications that are subject to atmospheric corrosion and therefore need to be protected. Using a metallic coating that will be sacrificed to increase the lifetime of the wire is a well-known method. Metallic coatings can be applied by different methods such as e.g. electroplating, physical or chemical vapor deposition or hot dip. Usual metallic coatings can be Sn, Zn, Cu, Al, Cr or their alloys.

While for some applications a very thin coating is sufficient to protect the steel wire against corrosion for its lifetime, in several cases a thick coating is necessary. This is for instance the case when steel wires are cabled or stranded. Their metallic coating can be damaged due to the friction between the wires, which may cause unprotected zones to be quickly corroded, leading to premature fracture.

In that case a thick and homogeneous layer is desired on the whole length of the steel wire.

The precise control of the coating thickness of a metallic layer can be obtained by different methods, but it appears that none of the existing methods is suitable for thick metallic coatings.

For example, CN105886990A discloses a control method and device for the zinc coating thickness of a steel wire. The device comprises a steel wire zinc smearing air knife and an air conveying pipe, and the steel wire zinc smearing air knife is connected with the air conveying pipe; the device is characterized by further comprising a first steel wire diameter measuring instrument, a second steel wire diameter measuring instrument, a PLC and an electromagnetic flow valve; the first steel wire diameter measuring instrument is used for detecting the actual diameter DO of the steel wire before zinc coating, the second steel wire diameter measuring instrument is used for detecting actual diameter D1 of the steel wire after zinc coating. The PLC controls the electromagnetic flow valve according to the data difference between a calculated diameter D2 of the steel wire and the actual diameter D1 of the steel wire, and through control over the air amount input to the steel wire zinc smearing air knife by the air conveying pipe, the zinc coating thickness of the steel wire is controlled.

The control method described in CN105886990A has been tested with the maximum zinc target coating weight of 250 g/m$^2$ on a 2 mm diameter steel wire. A decreasing linear relation between the zinc layer thickness and the air flow is assumed.

DISCLOSURE OF INVENTION

It has been observed that, to obtain thick zinc or zinc-aluminum alloy layers with a standard gas-knife nozzle, e.g. with a coating weight above 250 g/m$^2$, for instance above 300 g/m$^2$ or above 350 g/m$^2$, the gas flow needed to be reduced below 5 m$^3$/h, for instance below 3 m$^3$/h or even below 1.5 m$^3$/h.

At those low flow rates, the nozzle, used to remove the excess molten metal at the surface a steel wire was not functioning correctly, causing large variations in the coating thickness. Rather than removing the excess molten metal at the surface of the steel wire, due to the low gas flow, uncontrolled solidification was causing different, unexpected behaviors, deviating from the usual linear decrease of coating weight with increasing gas flow.

As a consequence, a constant coating thickness could not be guaranteed.

The relation between the metallic coating thickness and the coating weight is given by the formula:

$$CW(g/m^2) = s.g. * d * 1000 * (1 + d/D)$$

Where CW is the coating weight, d is the coating thickness in mm, D is the bright steel wire diameter and s.g. is the density of the metallic alloy, e.g. 7.12 kg/dm$^3$ for pure Zinc.

The purpose of the invention is to solve the issue raised before by providing a control method and device to precisely control the thickness of a metallic coating on a steel wire.

It is a first object of the invention to provide a method to control the thickness of a metallic coating on a steel wire. In particular, the method allows to control the thickness of a metallic coating on a steel wire in conditions deviating from the usual linear decrease of coating weight or thickness with increasing gas flow.

The method comprises the following steps:

- A first data set is produced and stored on a computer or PLC: this is a relation between the analog current reference in mA for the proportional valve and the coating thickness in μm as measured by a thickness sensor for the nozzle in use;
- A second data set is produced and stored on a computer or PLC: this is a relation between the analog current reference in mA for the proportional valve and the flow rate in m$^3$/h as measured by the digital flow meter for the nozzle in use;
- By combining the first data set and the second data set a relation between the coating thickness in μm and the flow rate in m$^3$/h is obtained. This relation is a calibration curve;
- The coating weight can be calculated from the coating thickness using the relation above and a relation between the coating weight in g/m$^2$ and the flow rate in m$^3$/h is obtained;
- A target coating weight or thickness is entered in the computer or PLC;
- The thickness of a metallic coating on a steel wire is measured continuously using a thickness sensor; The thickness sensor can be a system of 2 devices measuring the wire diameter before and after coating, by means of contact or laser for instance. In that case the coating thickness is obtained by subtracting the bright wire diameter from the coated wire diameter, and dividing the result by 2. Preferably, the thickness sensor is measuring directly the thickness of the coating using the eddy current technique. In that case only one thickness sensor is needed;
- The measured thickness is compared with a calibration curve previously established, giving the relation between the coating thickness and the gas flow for the nozzle in use. The method to produce calibration curves is described further below. The type of nozzle, its distance to the wire and the gas flow determine the amount of metallic coating remaining on the wire after exiting the molten metal bath. The relation obtained by combining the first data set and the second data set between the coating thickness and the gas flow may be linear or parabolic. The derivative of the relation obtained by combining the first data set and the second data set between the coating thickness and the gas flow can have a positive or negative coefficient. A positive coefficient means that the coating thickness is increasing with the increasing gas flow, which is the opposite of the usual nozzle behaviour. The method of the invention allows to account for any deviation from the usual linear decreasing relation between the coating thickness and the gas flow, the derivative of which has a negative coefficient. The comparison between the measured and calculated coating thickness for a given gas flow is made using a computer program stored on an external computer or preferably on a programmable logic controller (PLC);

The opening of a digital valve is automatically adjusted while measuring the gas flow with a digital flow meter such that the target metallic coating thickness is obtained according to the calibration curve. This last step can be decomposed in the following substeps:

i. Sending with the computer or PLC a feed forward analogue current reference in mA to the proportional valve, according to the relation provided by the second data set;

ii. Correcting with the computer or PLC the feed forward analogue current reference in mA until the real flow measured by the digital flow meter is equal to the flow needed to reach the target coating thickness according to the relation provided by said first data set.

The method may also include the steps of nozzle detection and calibration. This means that by sending an instruction (e.g. by pressing a button) the steps of producing and storing the first data set, producing and storing the second data set and the obtention of the calibration curve are fully automatised.

The method is particularly suitable for metallic coating thicknesses in the range between 35 μm and 115 μm. This corresponds e.g. with pure Zinc to coating weights between 250 g/m$^2$ and 1200 g/m$^2$. The relation between the metallic coating thickness and the coating weight is given by the formula:

$$CW(g/m^2) = s.g. * d * 1000 * (1 + d/D)$$

Where CW is the coating weight, d is the coating thickness in mm, D is the bright steel wire diameter and s.g. is the density of the metallic alloy, e.g. 7.12 kg/dm$^3$ for pure Zinc.

The method is valid for any coating weight from 30 g/m$^2$ to 1200 g/m$^2$. The method is more suitable for coating weight ranging from 250 g/m$^2$ to 1200 g/m$^2$, e.g. from 300 g/m$^2$ to 1100 g/m$^2$ or from 350 g/m$^2$ to 1000 g/m$^2$.

With the method disclosed previously the variation of coating thickness along a steel wire is less than 10% of the target coating thickness.

The metallic coating can be consisting of Sn, Zn, Cu, Al, Cr or their alloys.

The metallic coating is preferably consisting of Zinc or Zn—Al or Zn—Al—X alloys, X being Sr, La, Cu, Ti, Ce, Mg, Ni, Si, or Cr.

A zinc aluminum coating may have an aluminum content ranging from 2 percent by weight to 12 percent by weight, e.g. ranging from 3% to 11%.

Other elements such as silicon (Si) and magnesium (Mg) may be added to the zinc aluminum coating. With a view to optimizing the corrosion resistance, a particular good alloy comprises 2% to 10% aluminum and 0.1% to 3.0% magnesium, the remainder being zinc. An example is 5% Al, 0.5% Mg and the rest being Zn.

The method is particularly suitable to control metallic coating thicknesses on steel wire having a diameter between 1 mm and 18 mm. The wire diameter does not have an influence on the method.

The term steel wire comprises but is not limited to:

high carbon steel wire;

low carbon steel wire;

stainless steel wire.

A typical high carbon steel has a carbon content (% C) ranging from 0.60% to 1.20%, e.g. 0.75% to 1.1%, a manganese content (% Mn) ranging from 0.10% to 1.0%, e.g. from 0.20% to 0.80%, a silicon content (% Si) ranging from 0.10% to 1.50%, e.g. from 0.15% to 0.70%, a sulphur content (% S) below 0.03%, e.g. below 0.01%, a phosphorus content (% P) below 0.03%, e.g. below 0.01%, the remainder being iron, all percentages being percentages by weight. Other elements as copper or chromium may be present in amounts not greater than 0.40%.

A typical low carbon steel has a carbon content (% C) ranging between 0.02% and 0.20%, e.g. 0.05% to 0.1%, a manganese content (% Mn) ranging from 0.10% to 1.0%, e.g. from 0.20% to 0.80%, a silicon content (% Si) ranging from 0.10% to 1.50%, e.g. from 0.15% to 0.70%, a sulphur content (% S) below 0.03%, e.g. below 0.01%, a phosphorus content (% P) below 0.03%, e.g. below 0.01%, the remainder being iron, all percentages being percentages by weight. Other elements as copper or chromium may be present in amounts not greater than 0.40%. Boron may be present in amounts not greater than 0.1%.

Stainless steel wire includes but is not limited to ferritic and austenitic grades such as those selected in the 200 and 300 series.

The 200 series is used for austenitic grades that contain manganese. These chromium manganese steels have a low nickel content (below 5 percent).

The 300 series is used to name austenitic stainless steels with carbon, nickel, and molybdenum as alloying elements. The addition of molybdenum improves corrosion resistance in acidic environments while nickel improves ductility. AISI 304 and 316 are the most common grades in this series.

It is a second object of the invention to disclose a device for controlling a metallic coating thickness on a steel wire comprising:

a digital proportional valve, for instance a pressure regulator with a control range 0.02-2 bar depending on the inlet gas flow;

a digital flow meter adapted to measure the adequate flow range, for instance 0.12-12 m$^3$/h in normal temperature and pressure conditions;

a pressure sensor;

a thickness sensor, for instance an Eddy current device;

a gas nozzle, which can be of the standard gas-knife type, or can be modified so that the angle between the gas flow and the wire becomes closer to 90°;

the means adapted to execute the steps of the method described above, i.e. a computer such as a laptop, or preferably a programmable logic controller (PLC) and a software.

The device of the invention differs from prior art devices in that it allows controlling metallic coating thicknesses when the relation between the gas flow and the coating thickness deviates from linearity, e.g. is parabolic, and when the derivative of when the relation between the gas flow and the coating thickness has a positive coefficient.

A display may be foreseen for easier interaction with the process and for visualization of e.g. calibration curves.

In a preferred embodiment the gas nozzle comprises at least two exit supplies. Depending on the design of the at least two exit supplies, different gas pressure can be obtained at different positions on the wire, allowing a better control of the metallic coating thickness.

The angle between the gas direction and the horizontal (perpendicular to the wire) at each exit supply is in the range −90° to +90° and may be different at each exit supply. With this modification, an increasing flow of gas at one of the exit supplies, results in a higher coating weight.

The relation between the gas flow and the coating thickness may thus have a positive coefficient.

The method and device disclosed above is suitable for any type of gas, e.g. nitrogen, argon, helium, hydrogen, or air or $CO_2$.

BRIEF DESCRIPTION OF FIGURES IN THE DRAWINGS

FIG. 1. Schematic description of the device for controlling heavy metallic coating weights on steel wire.

Figure 2:
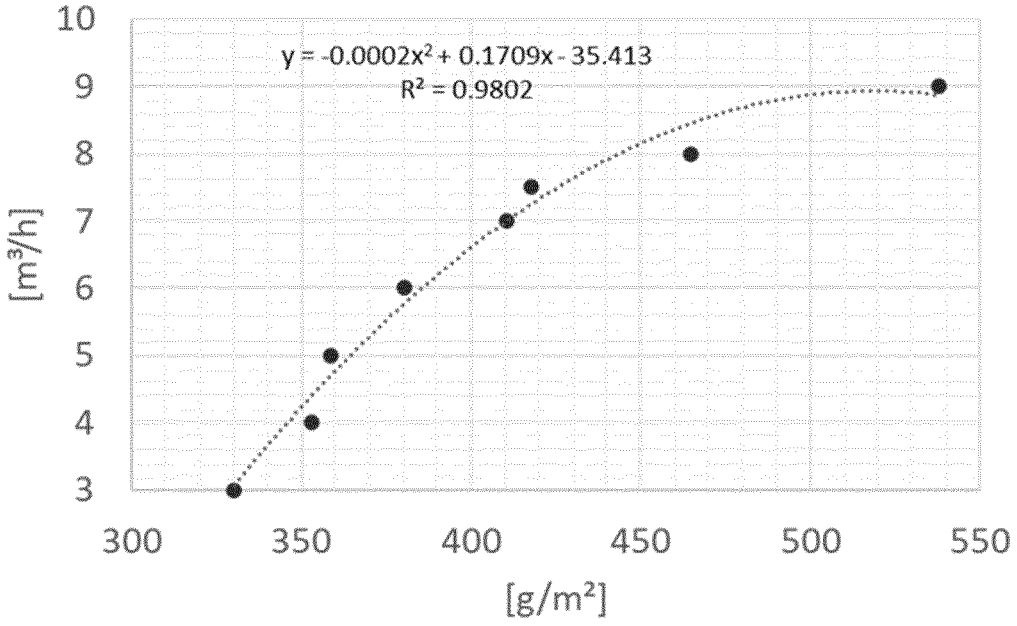

FIG. 2. Example of 'flow rate vs coating weight' calibration curve.

Figure 3:
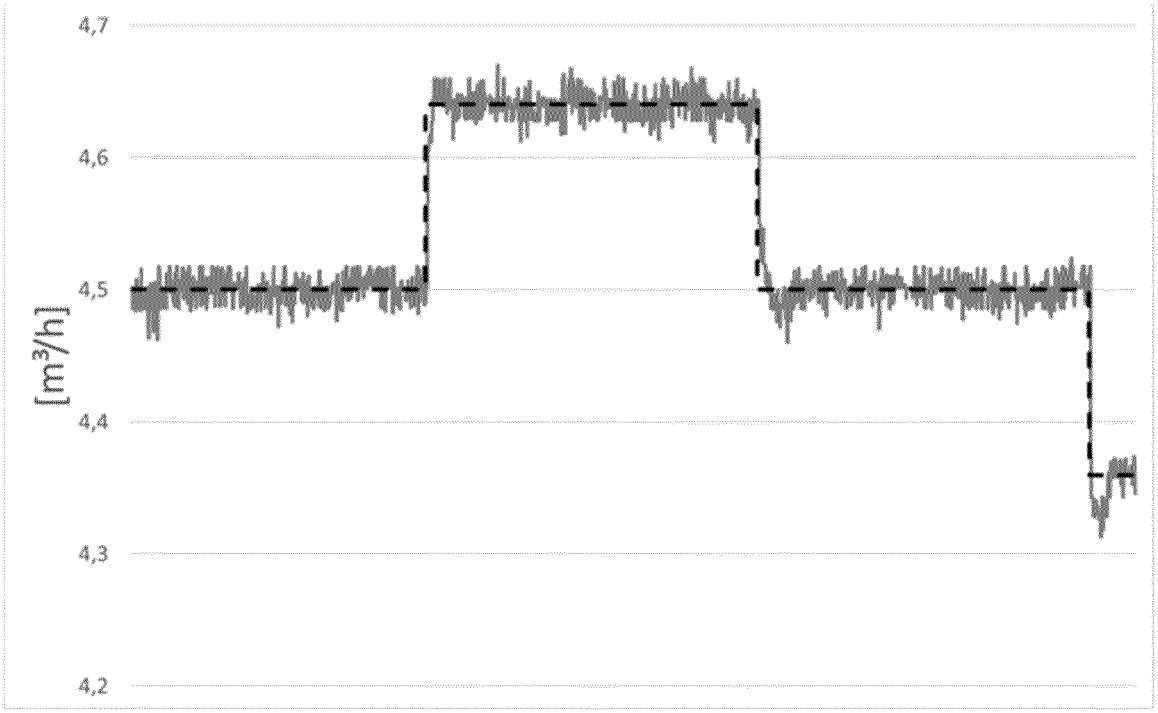

FIG. 3. Measured flow rate vs target as a function of time.

MODE(S) FOR CARRYING OUT THE INVENTION

FIG. 1. is a schematic representation of the device of the invention. The device 101 comprises:

- a digital proportional valve 113. It is used to control the gas pressure in the range 0.02-2 bar;
- a digital flow meter 111;
- a pressure sensor 115;
- a thickness sensor 105. In the present case an Eddy current device was used;
- a gas nozzle 119;
- a computer 107. Preferably, the computer is a programmable logic controller (PLC);

In FIG. 1. An optional flow restrictor 117 is also represented.

The steel wire 123 with a metallic coating 125 at its surface are also represented.

The present device was tested with nitrogen (N2) as thickness controlling gas. The flow of N2 is indicated in FIG. 1. by the arrows 109. The maximum pressure of N2 at the entry of the digital flow meter 111 was 2 bars.

The flow rate reaching the gas nozzle 119 was between 0 and 11.4 $m^3/h$ in normal conditions, i.e. assuming 1 bar pressure behind the proportional valve 113.

The computer program stored in the computer 107 allows different controls of the device. The target coating weight and type of nozzle are first entered in the computer.

For low coating weights, i.e. below 250 $g/m^2$ the standard type of gas-knife nozzles is used with high flow rate, i.e. above 5 $m^3/h$, and a negative linear relation between the coating weight CW and the gas flow rate V is observed of the type:

$$V=-a\ CW+b.$$

A negative coefficient means that the coating thickness decreases when the gas flow increases.

To reach thicker coatings or higher coating weight, e.g. above 250 $g/m^2$ or above 300 $g/m^2$, the gas nozzle is modified such that the gas flows through at least 2 exit supplies, one at the bottom and one at the middle or at the top of the nozzle. As an illustration, the nozzle represented in FIG. 1 contains 2 exit supplies.

The angle between the gas direction and the horizontal (perpendicular to the wire) at each exit supply is in the range −90° to +90° and may be different at each exit supply. With this modification, an increasing flow of nitrogen at one of the exit supplies, results in a higher coating weight.

The relation between the gas flow and the coating thickness may thus have a positive coefficient.

The correlation can also be parabolic:

$$V = a\ CW^2 + b\ CW + c.$$

An example of such a parabolic relation between the coating weight and the gas flow is shown in FIG. 2.

The derivative $$\left(\frac{dV}{dCW} = 2a\ CW + b\right)$$

is calculated at the process value of the coating weight. This is a local linearization of the slope of the step which needs to be taken to go to the next point. The next step in flow is calculated as $\Delta V=(2\ a\ CW_{PV}+b)\Delta CW$. The $\Delta V$ is than added up to the actual flow rate at that moment.

FIG. 2. has been obtained with pure zinc as metallic coating. Using a Zn—Al alloy, higher coating thickness up to 800 $g/m^2$ was obtained with 9 $m^3/h$ using the same set-up.

Method Implementation:

The target coating weight is entered in the computer 107. The thickness sensor 105 gives a (feed forward) reference towards the proportional nitrogen valve 113. This feed forward is corrected (in positive or in negative direction) to achieve the real flow measured by the digital flow meter 111. Using a feed forward gives a more stable control. A 'calibration' of valve/nozzle combination is needed. The calibration starts automatically pushing a button.

The system needs a series of data to make the correlation between flow and coating weight when a modified nozzle for thick coatings is used. Using the coating weight, the system controls and adjusts, step by step, towards the correlated flow rate. A PID controller may be used to compensate the error between the desired flow and the real flow.

Nozzle Detection and Calibration:

In standard (low thickness coating) mode, the scanning makes a relation data set between analogue current (mA) reference for the proportional valve 113 and the flow ($m^3/h$) measured by the digital flow meter 111. This relationship used as a feed forward for valve position.

In thick coating mode, the scanning detects 2 relations. These relations are simultaneously made, thus having the same X-axis. The first data set is a relation between the analogue current (mA) reference for the proportional valve 113 and the coating weight ($g/m^2$) as measured by the thickness sensor 105. The second data set is a relation between the analogue current (mA) reference for the proportional valve 113 and the flow rate ($m^3/h$) as measured by the digital flow meter 111. By combining the first and the second data sets, the relation between the coating weight ($g/m^2$) and the flow rate ($m^3/h$) is retrieved. FIG. 2. is a calibration curve obtained following the steps described above. The calibration curve can be generated automatically.

FIG. 3. is a comparison between the target flow (dotted line) and the measured flow (solid line) in $m^3/h$ as a function of time. The precise control of the flow (+/−0.02 $m^3/h$) ensures stable coating weight. For target coating weights in the range between 250 $g/m^2$ and 1200 $g/m^2$ standard deviations lower than 10% of the target coating weight were measured, e.g. less than 25 $g/m^2$ for 250 $g/m^2$ and less than 120 $g/m^2$ for 1200 $g/m^2$.

The invention claimed is:

1. A method to control the thickness of a metallic coating on a steel wire comprising the steps:

producing and storing on a computer system 107 a first data set with a relation between a current reference for a proportional valve 113 and a coating thickness of the metallic coating on the steel wire as measured by a thickness sensor 105;

producing and storing on the computer system 107 a second data set with a relation between the current reference for the proportional valve 113 and a flow rate as measured by a digital flow meter 111;

entering a target coating thickness in the computer system 107;

measuring the thickness of a metallic coating on a steel wire using a thickness sensor 105 and sending said measured thickness to the computer system 107;

sending with the computer system 107 a feed forward current reference to the proportional valve 113, according to the relation provided by said second data set; and correcting with the computer system 107 said feed forward current reference until the flow measured by the digital flow meter 111 is equal to a flow needed to reach said target coating thickness according to the relation provided by said first data set.

2. The method according to claim 1, wherein a relation obtained by combining said first data set and said second data set between the coating thickness and a gas flow is linear or parabolic.

3. The method according to claim 1, wherein the method uses a gas nozzle 119 comprising at least two exit supplies and/or wherein an angle between the gas direction and the horizontal is different for the at least two exit supplies and/or wherein a different gas at a given pressure is displayed for each exit supply.

4. The method according to claim 1, wherein a derivative of the relation obtained by combining said first data set and said second data set between a coating thickness and a gas flow has a positive coefficient such that the coating thickness increases with an increased gas flow.

5. The method according to claim 1, wherein the production of said first data set and said second data set is automatised.

6. The method according to claim 1, whereby uniform metallic coating thicknesses selected in a range between 35 μm and 115 μm are obtained.

7. The method according to claim 1, wherein the method controls the thickness of the metallic coating on the steel wire, the steel wire having a diameter between 1 mm and 18 mm.

8. The method according to claim 1, wherein the metallic coating is selected from the group consisting of Zinc er and Zn—Al—X alloys, wherein X is Sr, La, Cu, Ti, Ce, Mg, Ni, Si, or Cr.

9. The method according to claim 1, wherein the standard deviation of coating thickness along a steel wire is less than 10% of the target coating thickness.

* * * * *